US005503795A

United States Patent [19]

Hubbard

[11] Patent Number: 5,503,795

[45] Date of Patent: Apr. 2, 1996

[54] PREFORM COMPACTION POWDERED METAL PROCESS

[75] Inventor: Theodore R. Hubbard, Smethport, Pa.

[73] Assignee: Pennsylvania Pressed Metals, Inc., Emporium, Pa.

[21] Appl. No.: 428,560

[22] Filed: Apr. 25, 1995

[51] Int. Cl.[6] ..... B22F 3/16

[52] U.S. Cl. ..... 419/38; 419/36

[58] Field of Search ..... 419/38, 36

[56] References Cited

U.S. PATENT DOCUMENTS

| | | | |
|---|---|---|---|
| Re. 28,301 | 1/1975 | Havel | 75/223 |
| 3,554,874 | 1/1971 | Mattia | 204/9 |
| 3,622,313 | 11/1971 | Havel | 75/226 |
| 3,723,585 | 3/1973 | Nussbaum | 264/45 |
| 3,841,870 | 10/1974 | Hamjian | 75/214 |
| 3,893,852 | 7/1975 | Bergman et al. | 75/224 |
| 4,065,303 | 12/1977 | Seilstorfer et al. | 75/226 |

*Primary Examiner*—Donald P. Walsh

*Assistant Examiner*—Daniel Jenkins

*Attorney, Agent, or Firm*—Jones, Day, Reavis & Pogue

[57] ABSTRACT

A process is disclosed for forming a pressed metal part in which a preform is inserted into a pressed metal mold. The mold is then filled with powdered metal. The powdered metal and preform are compacted to create a compacted metal part wherein the preform defines an adjacent volume next to the compacted metal part. The compacted metal part is ejected from the mold and sintered to create a sintered metal part. The preform is removed by the sintering step in such a way that the adjacent volume becomes a void region. The preform can be formed of copper so that, upon sintering, the preform is removed from the sintered metal part through infiltration. Alternatively, the preform can be formed of zinc so that, upon sintering, the preform is vaporized and thereby removed from the sintered metal part. The void region created by the removal of the preform can be an undercut, a taper, an annular groove, a thread or an internal cavity. In this way, the present invention eliminates the need for machining such surfaces as has been necessary using previous compaction methods.

11 Claims, 4 Drawing Sheets

PREFORM COMPACTION POWDERED METAL PROCESS

BACKGROUND OF THE INVENTION

The present invention is directed to the field of pressed and sintered powdered metal components. The present invention has particular applicability to pressed metal parts which require annular grooves, undercuts, internal cavities and the like.

In recent times, powder metallurgy (P/M) has become a viable alternative to traditional casting and machining techniques for fashioning metal components. In the P/M process, powdered metal is added to a mold and then compacted under very high pressures, typically between about 20–80 tons per square inch. The compacted part is ejected from the mold as a "green" part. The green parts are then sintered in a furnace operating at temperatures of typically 2000°–2500° F. The sintering process effectively welds together all of the individual powered metal grains into a solid mass of considerable mechanical strength. The P/M process can be generally used to make parts from any type of metal and sintering temperatures are primarily determined by the temperatures of fusion for each metal type.

P/M parts have several significant advantages over traditional cast or machined parts. P/M parts can be molded with very intricate features that eliminate much of the cutting that is required with conventional machining. P/M parts can be molded to tolerances within about 4 or 5 thousandths, a level of precision acceptable for many machine surfaces. Surfaces which require tighter tolerances can be quickly and easily machined since only a very small amount of metal need be removed. The surfaces of P/M parts are very smooth and offer an excellent finish which is suitable as a bearing surface.

The P/M process is also very efficient compared with other processes. P/M processes are capable of typically producing between 200–2000 pieces per hour depending on the size and the degree of complexity. The molds are typically capable of thousands of service hours before wearing out and requiring replacement. Since almost all of the powdered metal which enters the mold becomes part of the finished product, the P/M process is about 97% materials efficient. During sintering, it is only necessary to heat the green part to a temperature which permits fusion of the metal powder granules. This temperature is typically much lower than the melting point of the metal, and so sintering is considerably more energy efficient than a comparable casting process.

P/M parts are inherently somewhat porous. Due to the nature of the metal powder and the compaction process, there are inherently some voids where the metal powder particles are not completely compacted. These voids are a function of compaction pressures and powder particle geometry. Consequently, the voids (and hence the porosity) can be controlled to whatever degree desired. Structural parts can be produced that are 80–95% as dense as solid metal parts with comparable mechanical strengths.

The porosity of P/M parts can be exploited to advantage. The voids essentially represent a "cavernous" network that permeates the microstructure of a P/M part. These voids can be vacuum impregnated with oil to create self-lubricated parts with properties that cannot be matched by conventional cast and machined parts. The porosity also creates significant sound damping which results in quieter parts that do not vibrate or "ring" during operation. Also, the pores can be filled with corrosion-resisting materials or "infiltrated" with molten metals to provide various material and metallurgical properties that could not be attained in conventional cast and machined parts.

In spite of the many advantages of P/M parts, they have previously suffered from certain drawbacks. P/M parts are molded under high pressures which are attained through large opposing forces that are generated by the molding equipment. These forces are applied by mold elements which move back and forth in opposing vertical linear directions. The P/M parts produced thereby have previously necessarily had a "vertical" profile. Such conventional mold tooling and operation requirements do not allow the formation of transverse features which are indented or recessed between the ends of the molded part. An example of such a P/M element illustrating the vertical profile limitation is shown in FIG. 1. Also, P/M parts must necessarily have a vertical profile to facilitate their release from the mold. Since mold elements move back and forth in opposing vertical directions, P/M parts formed with transverse features, i.e. grooves, undercuts, crosscuts or threads would inhibit mold release. As seen in FIG. 2, such profile features had previously required a secondary machining step which adds greatly to the cost of the part, creating an economic disincentive to P/M fabrication.

The conventional P/M process is also not suitable for fashioning elements that have steeply sloped surfaces. If a surface is too steeply tapered the mold pressures will force the powder from the mold, thus prohibiting the formation of a tapered portion. Thus, tapered members of this type also require secondary machining.

Previous attempts have been made to provide P/M parts with other than a transverse profile. One such attempt is to use a split die. With this method a die is provided which has a transverse profile features incorporated onto the die surface. The die is vertically split into sections which reciprocate horizontally. After compaction by the vertical application of force, the split die opens horizontally to release the green part. This method is very limited. The transverse profile section cannot be too large or else it will interfere with powder fill. Also, a large profile could interfere with mold release, resulting in damaged green parts and equipment down time. Additionally, the transverse profile section cannot be too small or else the die section becomes prone to breakage under the compaction pressures. In general, the mechanics of split die compaction are very complicated and prone to difficulties. In view of the limitations and complications of this technique, split die compaction does not provide an economically viable alternative to the conventional P/M process.

Another method of creating P/M parts with grooves, undercuts and the like is to sinter bond two green parts. As seen in FIG. 3, two parts with appropriately tapered surfaces are individually compacted and fitted together prior to sintering. Upon sintering, the two parts become bonded together to form an integral part with an appropriately placed groove or undercut. While this method is effective, a double compacting step is required since each part must be formed separately and then assembled prior to sintering. The sinter bonding process also requires two complex sets of tools as well as careful material considerations. Thus, this technique also fails to provide an economically viable alternative to the conventional P/M process.

SUMMARY OF THE INVENTION

In view of the above-noted disadvantages encountered in prior processes, there is a need for a process to produce a P/M part which has other than a vertical profile.

There is also a need for a P/M process which reduces the need for secondary machining.

There is also a need for a P/M process which provides a grooved, undercut, or internal surface with one compacting step.

There is also a need for a P/M part which permits efficient machining without extensive removal of metal.

There is also a need for a P/M process which reduces traditional engineering limitations.

The above and other needs are satisfied by the present invention are realized in a process for forming a pressed metal part including the steps of inserting a preform into a pressed metal mold and filling the mold with powdered metal. The powdered metal and preform are compacted to create a compacted metal part wherein the preform defines an adjacent volume next to the compacted metal part. The compacted metal part is ejected from the mold and sintered to create a sintered metal part. The preform is removed by the sintering step in such a way that the adjacent volume becomes a void region.

The preform can be formed of copper so that, upon sintering, the preform is removed from the sintered metal part through infiltration. Alternatively, the preform can be formed of zinc so that, upon sintering, the preform is vaporized and thereby removed from the sintered metal part. The void region created by the removal of the preform can be any manner of shape, including an undercut, a taper, an annular groove, a thread or an internal cavity. In this way, the present invention permits the creation of P/M parts having surfaces with other than vertical profile features such as have not been available through previous methods.

The above and other features of the invention will become apparent from consideration of the following detailed description of the invention which presents a preferred embodiment of the invention as is particularly illustrated in the accompanying drawings.

DETAILED DESCRIPTION OF THE INVENTION

Figure 1:
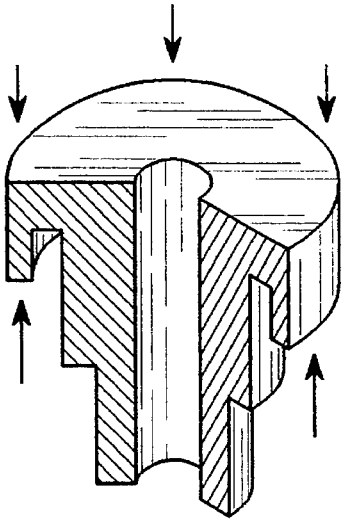
FIG. 1 is a cutaway view illustrating a common type of P/M part which includes the vertical profile limitations inherent in the previous process.
Figure 2:
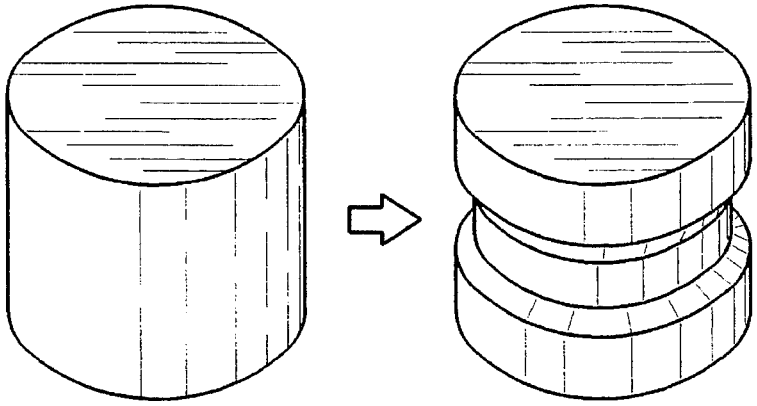
FIG. 2 shows the secondary machining applied to P/M parts made by the previous process for adding features having other than a vertical profile.
Figure 3:
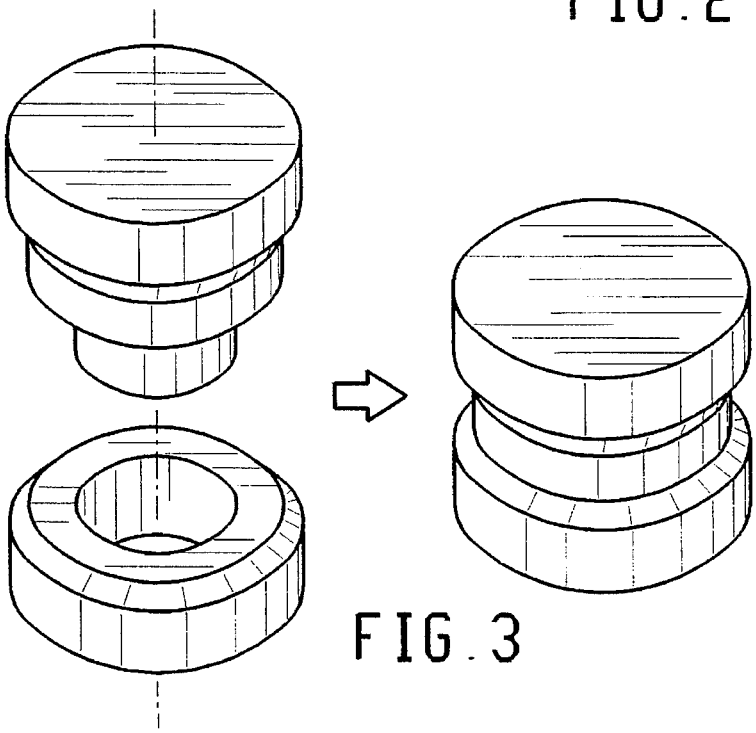
FIG. 3 illustrates a grooved member formed by sinter welding two parts in accordance with a previous technique.
Figure 4:
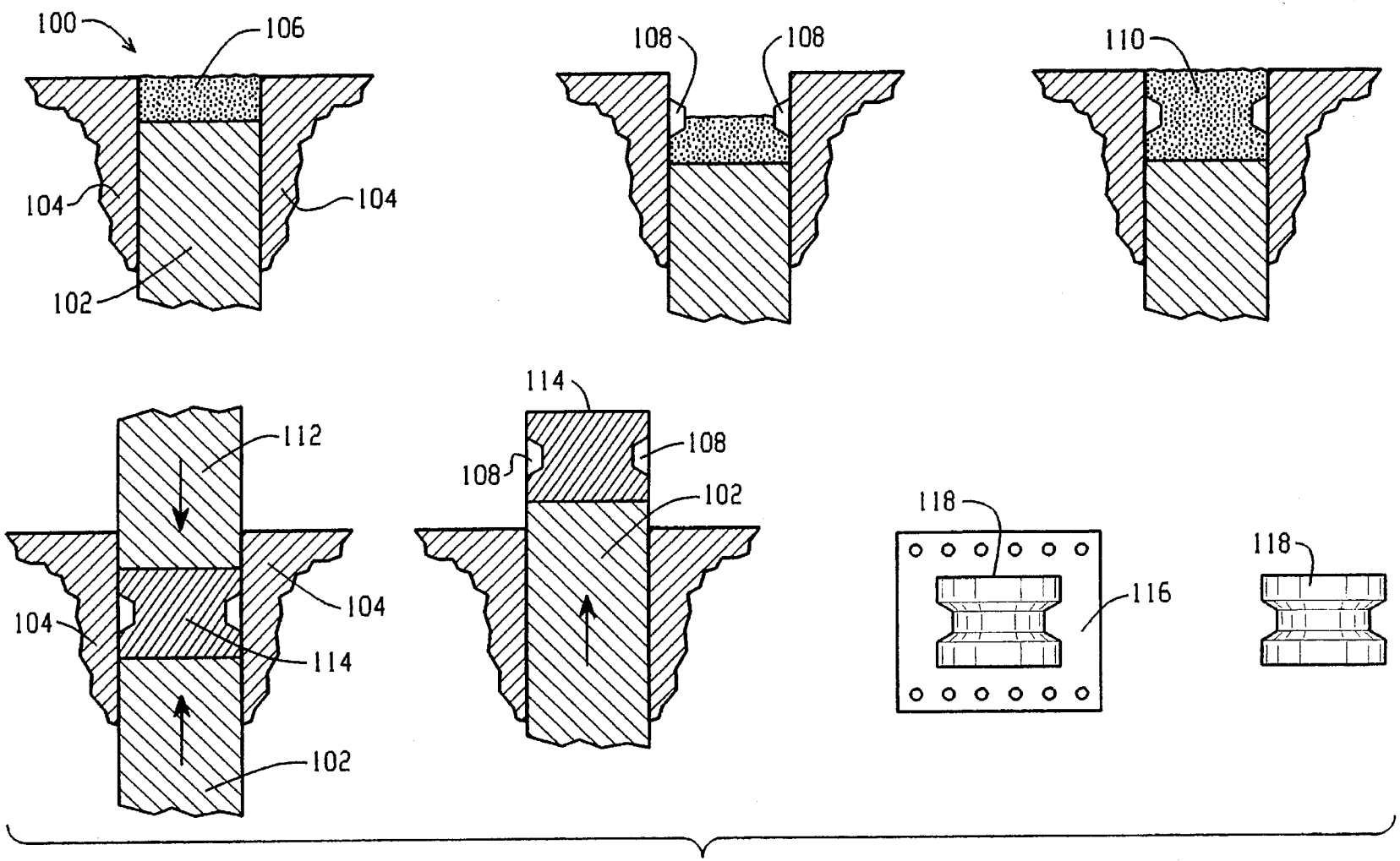
FIG. 4 depicts the steps of the process of the present invention including preform compaction and sinter removal of the preform to create a desired void region.
Figure 5A:
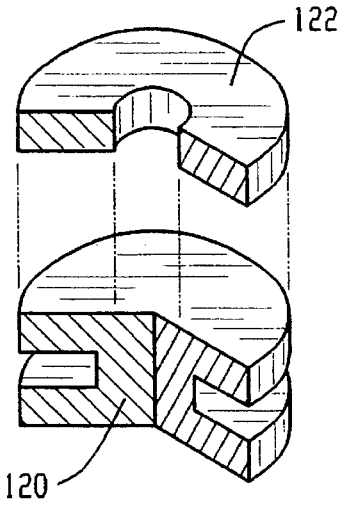
FIGS. 5A, 5B, 5C and 5D show types of P/M parts which can be formed using the preform compaction and removal in accordance with the present process.
Figure 5B:
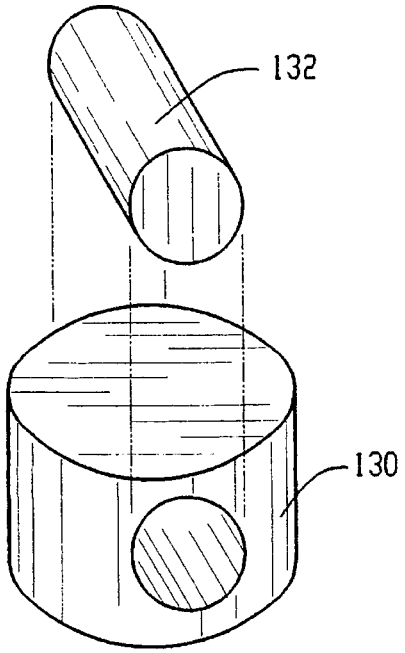
Figure 5C:
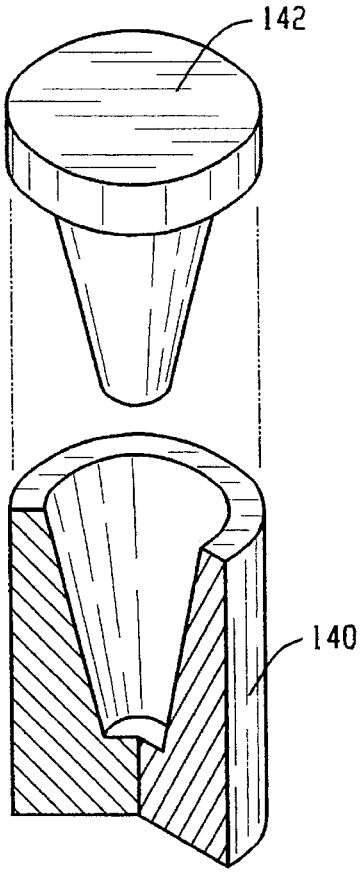
Figure 5D:
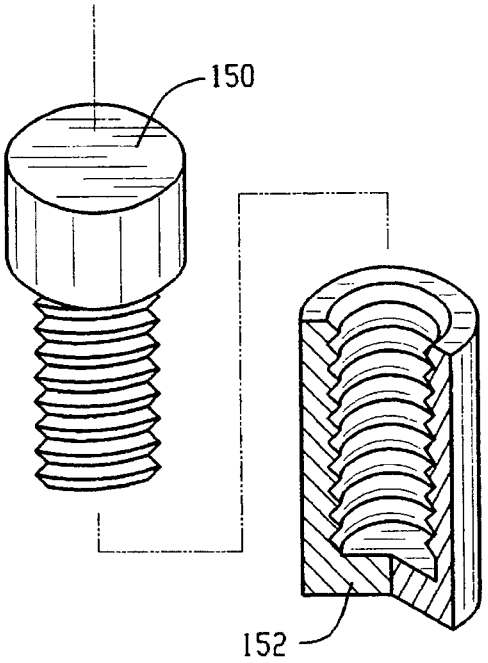

The present P/M process solves the problems of the previous system by providing a compaction technique using a removable preform which is used to create undercuts, annular grooves, internal cavities and the like. Referring now to FIG. 4, a P/M mold 100 is provided which uses a lower punch 102 and a die 104. In an optional preliminary first step, the mold 100 is partially prefilled with an amount of powdered metal 106. This optional prefill can be lightly compacted to tamp the powder into an approximation of its final volume.

Whether or not a prefill step is performed, a preform 108 is inserted into the mold 100. The preform 108 is preferably a compacted green part itself, formed by a previous compaction step. However, the preform can be casted or otherwise formed. The preform 108 is formed of a material which has a melting point lower than the temperature of fusion of the powdered metal to be sintered. For example, if the metal powder is a ferrous metal, having a fusion temperature of 2050° F., the preform is made of copper or zinc, which have respective melting temperatures of 1980° F. and 787° F.

In the preferred embodiment, after preform insertion, the mold 100 is fully filled with metal powder 110. The amount of metal powder 110 in the mold is important since the size of the finished product is determined by the amount of powder and the degree of compaction. After filling, the powder is compacted. An upper punch 112 is brought down into the mold 100 and large forces are applied between the upper punch 112 and the lower punch 102 in order to create the tons per square inch pressures necessary for full compaction. After compaction, the compacted part 114 is ejected from the mold 100 with the preform 108 compacted therein. The preform defines a volume which lies along a surface adjacent to the compacted part 114. This volume corresponds to the shape of the desired feature (i.e. groove, undercut, etc.)

After ejection, the compacted part 114 with preform 108 is sintered in a sintering oven 116. As the temperature of fusion is reached, the preform is melted off. In a ferrous part as according to the preferred embodiment, a copper preform would melt and be absorbed into the porous network of the compacted part 114. This absorption or "infiltration" results in a finished part with improved strength and metallurgical properties. The preform 108 can also be formed of a material such as zinc, which has a vaporization temperature of 1665° F. As the fusion temperature of a ferrous part is approached, the zinc melts and then vaporizes to become part of the furnace atmosphere. In this way, no portion of the preform 108 remains on the finished part.

After sintering, a finished sintered part 118 remains. The perform 108 has been completely removed by the sintering process. The preform 108 is necessarily formed with a "mirror image," i.e. a reverse profile of the desired groove. As the preform is removed by sintering, a void region is left adjacent to the sintered part 118 which corresponds to the desired profile, i.e. a groove, undercut, thread or the like. In this way, complicated transverse P/M part profile features can be generated which were not previously possible without secondary machining. In eliminating these machining steps, P/M parts with such complicated profiles can be generated for between ⅓ to 1/10 of the cost of parts requiring secondary machining, representing a significant economic improvement over such previous methods.

Examples of preforms and the parts made by the present process are shown in FIG. 5. As seen in FIG. 5A, a part 120 with a deep undercut can be made by first inserting the appropriate preform 122. FIG. 5B shows a crosshole member 130 formed using a cylindrical preform 132. FIG. 5D illustrates a piece 140 with a tapered surface having a reverse profile of that of the respective preform 142. FIG. 5D depicts a threaded member 150 by a threaded preform 152.

Figure 6A:
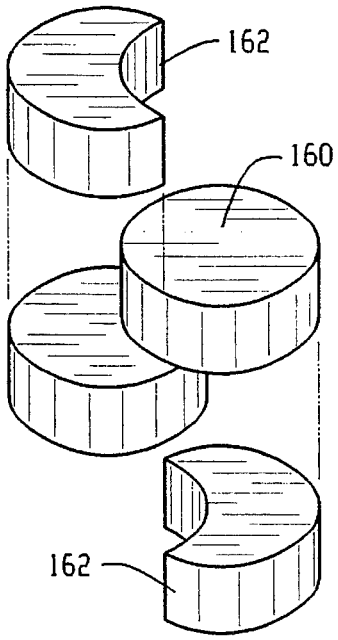
FIGS. 6A, 6B, 6C and 6D show asymmetrical types of P/M parts which can also be made in accordance with the present process.
Figure 6B:
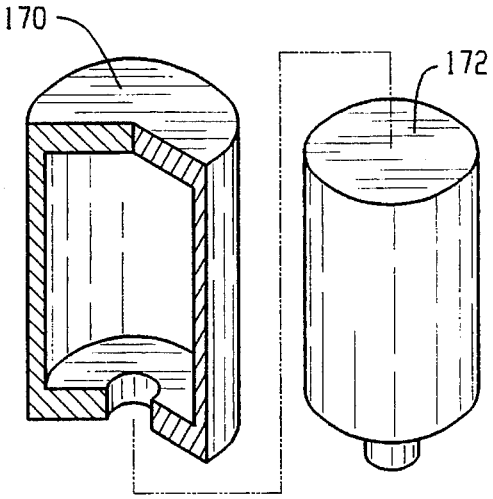
Figure 6C:
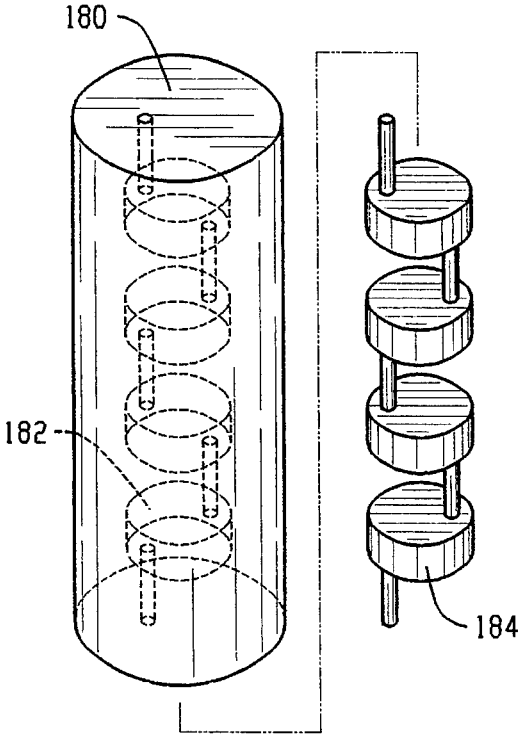

Heretofore unconsidered P/M part designs can now be considered with the present process. As seen in FIG. 6A, proper preform design permits P/M parts with asymmetrical profiles 160 to be produced by creating an off-center preform 162. As shown in FIG. 6B, even parts 170 with a substantially large internal cavity 172 can be created using a preform 108 which is removed to leave behind a hollow region within a part. As depicted in FIG. 6C, complicated parts such as hydraulic cylinders 180, with highly complex internal profiles 182 can now be P/M processed without secondary machining by using an appropriate preform 184.

Figure 6D:
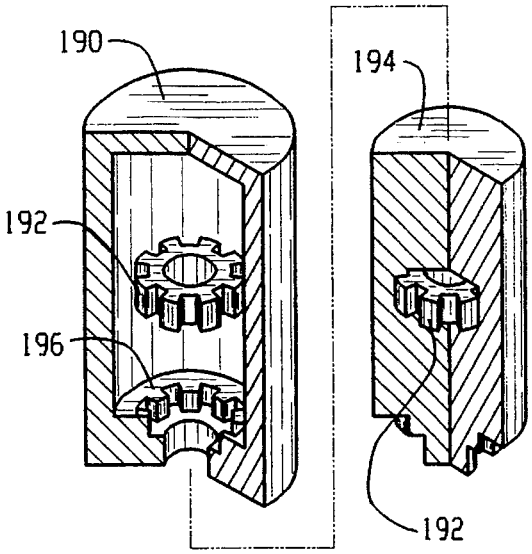

As shown in FIG. 6D, it can even be possible to create a part 190 with an internal part 192 inside an internal cavity by imbedding the internal part 192 in the preform 194 prior to compacting. This internal part 192 can be, for example, an internal gear 192 which can ride within an internal gear profile 196 inside the internal cavity 194 with no apparent means for the ingress of the gear. As the potential of the present process is explored, P/M engineers will be able to design parts which exploit these advantages, thereby greatly expanding the potential for many types of future P/M products.

The foregoing description of the preferred embodiment has been presented for purposes of illustration and description. It is not intended to be limiting insofar as to exclude other modifications and variations such as would occur to those skilled in the art. Any modifications such as would occur to those skilled in the art in view of the above teachings are contemplated as being within the scope of the invention as defined by the appended claims.

I claim:

1. A process for forming a pressed metal part comprising the steps of:

a) inserting a preform into a pressed metal mold;

b) filling the mold with a powdered metal;

c) compacting the powdered metal with the preform to create a compacted metal part, wherein the preform defines an adjacent volume next to the compacted metal part;

d) ejecting the compacted metal part from the mold;

e) sintering said compacted metal part to create a sintered metal part, wherein the preform is substantially removed by said sintering such that said adjacent volume becomes a substantially void region.

2. The process of claim 1 wherein, upon sintering, the preform is removed through infiltration into the sintered metal part.

3. The process of claim 2 wherein the preform comprises copper.

4. The process of claim 1 wherein, upon sintering, the preform is removed through vaporization.

5. The process of claim 4 wherein the preform comprises zinc.

6. The process of claim 1 wherein said void region comprises an undercut.

7. The process of claim 1 wherein said void region comprises a taper.

8. The process of claim 1 wherein said void region comprises an annular groove.

9. The process of claim 1 wherein said void region comprises a thread.

10. The process of claim 1 wherein said void region comprises an internal cavity.

11. The process of claim 1 further comprising the step of:

prior to inserting the perform, pre-filling the mold with a predetermined amount of the powdered metal and lightly compacting the powder to tamp the powder to an approximation of its final volume.

* * * * *